US005884370A

United States Patent [19]

Bergamin

[11] Patent Number: 5,884,370

[45] Date of Patent: Mar. 23, 1999

[54] LEVER, PARTICULARLY FOR SPORTS SHOES

[75] Inventor: Mirco Bergamin, Castelfranco Veneto, Italy

[73] Assignee: Alpinestars Research S.r.l., Coste Di Maser, Italy

[21] Appl. No.: 812,510

[22] Filed: Mar. 7, 1997

[30] Foreign Application Priority Data

Mar. 8, 1996 [IT] Italy ..... TV96A0032

[51] Int. Cl.[6] ..... A43C 11/00; A43B 21/00

[52] U.S. Cl. ..... 24/715 K; 24/685 K; 24/705 K; 36/50.1

[58] Field of Search ..... 24/685 K, 68 R, 24/695 K, 705 K, 715 K; 36/50.1

[56] References Cited

U.S. PATENT DOCUMENTS

| | | | |
|---|---|---|---|
| 4,395,801 | 8/1983 | Gabrielli | 24/70 SK |
| 4,453,290 | 6/1984 | Riedel | 24/70 SK |
| 4,470,175 | 9/1984 | Chiarella | 24/71 SK X |
| 5,172,454 | 12/1992 | Martignago | 24/71 SK X |
| 5,526,555 | 6/1996 | Battistella et al. | 24/71 SK X |
| 5,530,997 | 7/1996 | Tessari | 24/70 SK X |
| 5,575,045 | 11/1996 | Chu | 24/68 SK |
| 5,606,779 | 3/1997 | Lu | 24/68 SK |

*Primary Examiner*—Anthony Knight
*Assistant Examiner*—Robert J. Sandy
*Attorney, Agent, or Firm*—Guido Modiano; Albert Josif

[57] ABSTRACT

A lever, particularly for sports shoes, including a base which is associable with a first flap of the shoe and from which two wings protrude, a pivot being interposed transversely with respect to the wings. The lever is constituted by a lever arm having, at one end, a seat for rotary and detachable connection to the pivot, and a protruding tab for temporarily locking the lever arm in the closed condition and which interact with the base.

13 Claims, 2 Drawing Sheets

LEVER, PARTICULARLY FOR SPORTS SHOES

BACKGROUND OF THE INVENTION

The present invention relates to a lever particularly for sports shoes.

Levers are currently known which are constituted by a lever arm freely and transversely pivoted at one end to a pivot which is in turn rotatably associated at a pair of wings which protrude from a base associable with a flap of the shoe.

A band is also transversely pivoted to said lever arm proximate to the free end and by means of an additional pivot and has, at its free end, a transverse set of teeth interacting in a ratchet-like fashion with a complementary set of teeth formed at an engagement element which is associated with the second flap of the shoe.

Said conventional levers, however, entail drawbacks: when the lever arm is closed, fastening is achieved by placing the axis of the first pivot at a level, with respect to the base, which is higher than the level of the second pivot of the toothed band, but this condition can change easily owing to the accidental impacts to which the lever arm or the toothed band are subjected during use of the shoe.

This problem is even greater when the shoe is constituted, for example, by a boot used in motocross.

Another drawback which can be observed in conventional levers resides in the fact that any impact of the lever arm against blunt objects which causes its deformation eliminates its functionality, requiring a replacement on the part of the user which cannot be performed with simple tools but requires sending the shoe to the manufacturer for complete replacement.

Another drawback is constituted by the fact that any impact at the toothed band can also cause the opening of the lever arm.

SUMMARY OF THE INVENTION

A principal aim of the present invention is therefore to solve the described problems, eliminating the drawbacks of the cited prior art and thus providing a lever which is structurally simple, has low costs, and remains in the closed position even if the lever arm or the toothed band are subjected to impacts against blunt objects.

Within the scope of this aim, an important object is to provide a lever which can be replaced quickly and simply even by the user himself in case of breakage.

This aim, these objects, and others which will become apparent hereinafter are achieved by a lever, particularly for sports shoes, comprising a base which is associable with a first flap of said shoe and wherefrom two wings protrude, a first pivot being interposed transversely with respect to said wings, characterized in that it is constituted by a lever arm having, at one end, first means for rotary and detachable connection to said first pivot, and second means for temporarily locking said lever arm in the closed condition and which interact with said base.

BRIEF DESCRIPTION OF THE DRAWINGS

Further characteristics and advantages of the invention will become apparent from the detailed description of a particular but not exclusive embodiment thereof, illustrated only by way of non-limitative example in the accompanying drawings, wherein.

DESCRIPTION OF THE PREFERRED EMBODIMENTS

Figure 1:
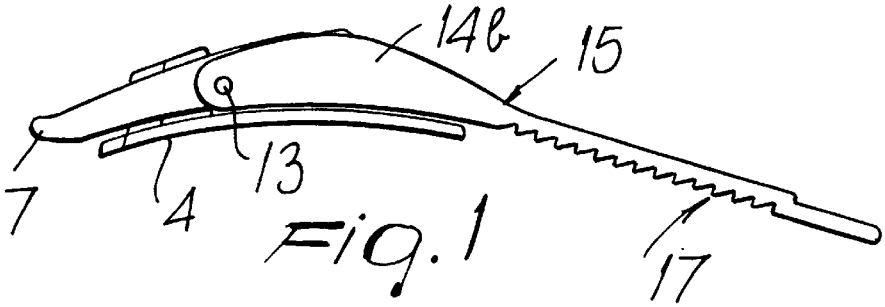
FIG. 1 is a side view of the lever without the engagement element.
Figure 2:
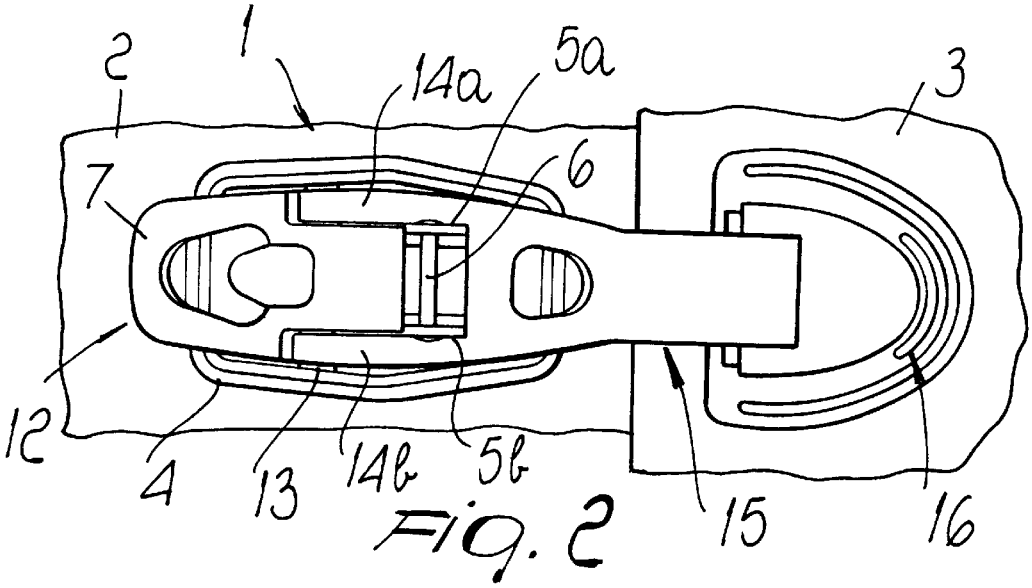
FIG. 2 is a top view of the lever.

With reference to the above figures, the reference numeral 1 designates a lever, particularly for fastening a first flap 2 and a second flap 3 of a sports shoe such as for example a motorcycling or motocross boot.

A base 4 is associable with the first flap 2, for example by stitching, and two wings 5*a*, 5*b* protrude from said base and are transversely connected to each other by a first pivot 6.

The lever 1 is constituted by a lever arm 7 having, at a first end 8, first means for rotary and detachable connection to the first pivot 6, said means being constituted by a first seat 9 formed transversely to the first end 8 and associable in a snap-together manner at the first pivot 6.

Said first seat 9 is formed at the surface of the lever arm 7 which does not face the base 4.

On the opposite side with respect to the first seat 9, the lever arm 7 has second means for temporarily locking it in the closed condition, said second means being constituted by at least one tab 10 which protrudes from the surface that faces the base 4 and is slightly curved, with its free end 11 directed towards the second end 12 of the lever arm 7 which can be gripped by the user.

Said tab 10 is flexible and has such dimensions as to interact with the underlying base 4 during the closure of the lever arm 6, so as to flex to one side to allow closure and to the other side so that once said closure has been completed the second end 12 of the lever arm 7 is pushed so as to remain in contact with the underlying base 4.

Figure 3:
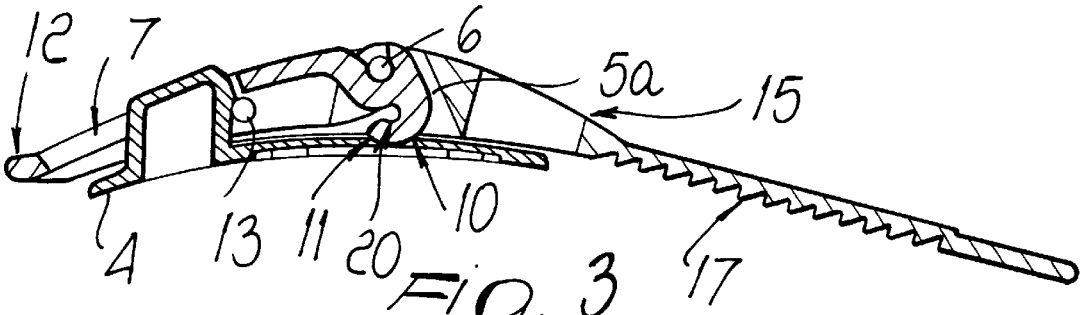
FIG. 3 is a sectional view, taken along a median plane lying longitudinally with respect to the lever arm of FIG. 1, in the condition in which the lever arm is closed.
Figure 8:
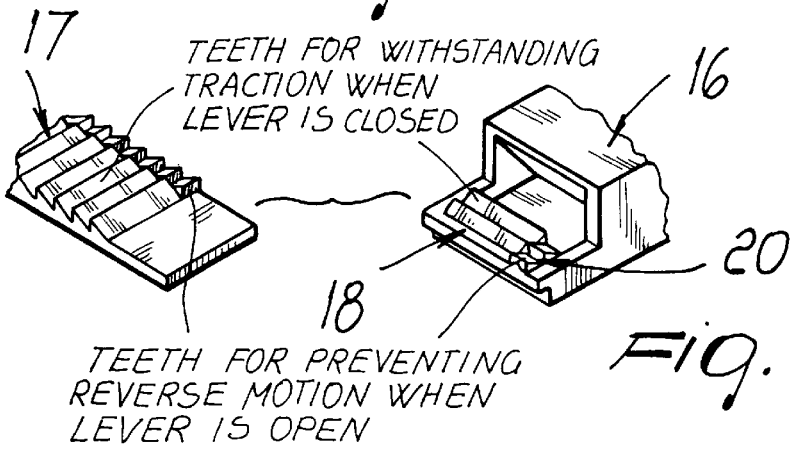
FIG. 8 is a view of two details of the first and second teeth formed on the band and of the first and second complementary sets of teeth formed on the engagement element.
Figure 4:
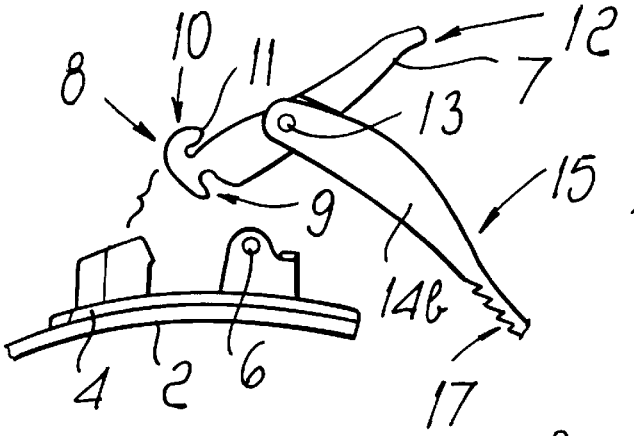
FIG. 4 is a side view of the lever arm uncoupled from the first pivot.
Figure 5:
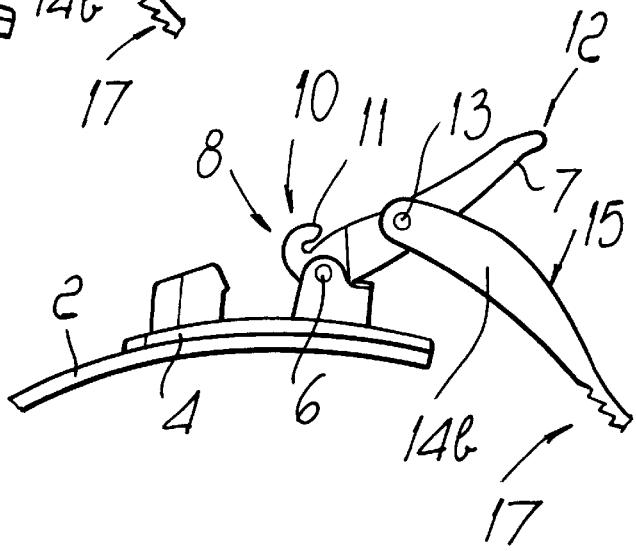
FIG. 5 is a view, similar to FIG. 4, of the lever arm rotatably coupled to the first pivot.
Figure 6:
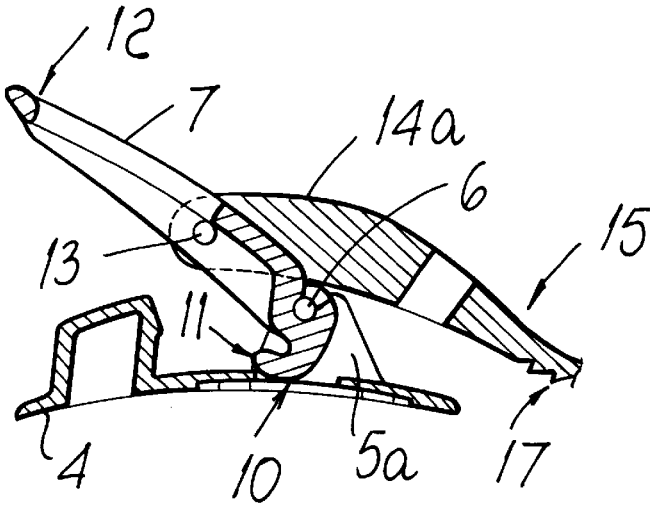
FIG. 6 is a view, similar to FIG. 3, of the condition in which the second means are activated during the closure of the lever arm.
Figure 7:
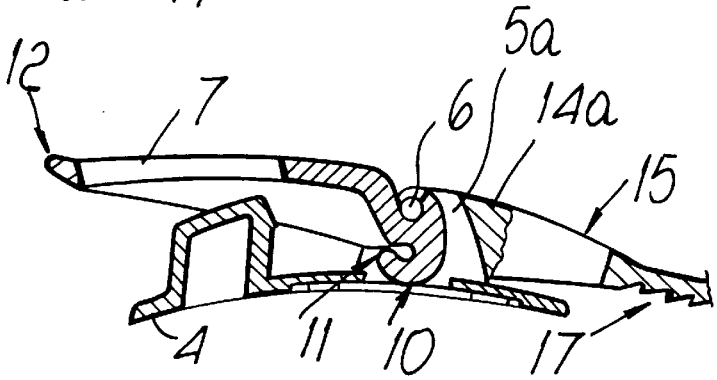
FIG. 7 is a view, similar to FIG. 6, of the lever arm in a nearly closed condition.

With respect to a longitudinal cross-section of the lever arm 7, the imaginary transverse axis of deformation of the tab 10, designated by the reference numeral 20 in FIG. 3, is placed at a greater distance, with respect to the second end 12 of the lever arm 7, than the transverse axis of the first pivot 6, so as to generate a moment which forces the lever arm 7 into contact with the base 4.

In a region which is intermediate between the first and the second ends, the lever arm 7 is pivoted transversely, by means of a second pivot 13, at the lugs 14*a*, 14*b* of a band 15 which is associable at an adapted engagement element 16 associable with the second flap 3 for example by stitching.

The engagement element 16 is internally hollow so as to allow to insert therein the free end of the band 15, said band having, at the surface which faces the second flap 3, first teeth 17 which are arranged transversely along part of the width of said band and interact in a ratchet-like fashion with an adapted complementarily-shaped first complementary set of teeth 18 formed at the underlying engagement element 16.

Advantageously, the first complementary set of teeth 18 is constituted by a limited number of teeth.

Second teeth 19, orientated in the opposite direction with respect to the first teeth 17, are provided on the band 15 adjacent to the first teeth 17, said second teeth interacting with a complementarily shaped second complementary set of teeth 20 formed on the engagement element 16 to the side of the first complementary set of teeth 18.

The first teeth 17 and the first complementary set of teeth 18 interact with each other to withstand traction when the lever arm is closed, whilst the second teeth 19 and the second complementary set of teeth 20 constitute a means for preventing reverse motion when the lever arm is open or closed.

Accordingly, when the lever arm is closed, as shown in FIGS. 1 and 3, any accidental impact at the lever arm does not cause it to open, and the dimensions of the tab 10 can be chosen so that it contrasts said opening up to a preset limit value.

Simultaneously, any impact on the band 15 towards the engagement element 16 is not transmitted to the lever arm 7 but is contrasted by the second complementary set of teeth 20.

Moreover, in case of impacts there is no takeup of the first or second teeth with respect to the engagement element 16; this avoids reducing the volume which is fastened by the lever.

It has thus been observed that the present invention has achieved the intended aim and objects, a lever having been provided which is free from accidental openings both for impacts at the lever arm and for impacts at the toothed band.

Moreover, the connection between the lever arm and the first pivot 6, associated by means of the pair of wings 5*a* and 5*b* with the first flap 2, allows on one hand to achieve optimum opening of the shoe flaps and on the other hand to rapidly and easily replace the lever arm if it accidentally breaks, since it is sufficient to extract the band when replacing it with another one provided with a new lever arm.

The lever is also always engaged even if the user loosens the lever arm for example for walking.

The lever arm can of course be made for example of metal or plastics according to the degree of rigidity to be achieved.

The present invention, which can be made of plastics, is also light and small dimensions can be chosen for the lever arm in order to better avoid accidental impacts and to increase forward flexing, for example if the lever is placed at the flexing region and at the tibial and foot region.

The present invention is of course susceptible of numerous modifications and variations, all of which are within the scope of the same inventive concept.

The dimensions and the materials constituting the individual components of the lever may of course also be the most pertinent according to specific requirements.

What is claimed is:

1. A lever, particularly for sports shoes, comprising a base which is associable with a first flap of said shoe and from which two wings protrude, a first pivot being interposed transversely with respect to said wings, wherein said lever is constituted by a lever arm having, at one end, first means for rotary and detachable connection to said first pivot, and second means for temporarily locking said lever arm in the closed condition and which interact with said base.

2. A lever according to claim 1, wherein a band is associated with said lever arm and has first and second teeth which interact respectively with a first and with a second complementary sets of teeth formed at a hollow engagement element associated with a second flap of said shoe.

3. A lever according to claim 2, wherein said first teeth which interact with said first complementary set of teeth are adapted to withstand an applied traction force when said lever arm is in the closed condition.

4. A lever according to claim 2, wherein said second teeth which interact with said second complementary set of teeth are adapted to prevent the sliding of said toothed band in a first condition in which the lever arm is open and in a second condition in which the lever arm is closed.

5. A lever according to claim 1, wherein said first means are constituted by a first seat formed transversely at a first end of said lever arm and associable in a snap-together manner at said first pivot.

6. A lever according to claim 5, wherein said first seat is formed at the surface of said lever arm which does not face said base.

7. A lever according to claim 6, wherein said lever arm has, at a part which is opposite to said first seat, said second means for temporarily locking said lever arm in closed condition, said second means for temporarily locking said lever arm in closed condition being constituted by at least one tab which protrudes from a surface of said lever facing said base and is slightly curved, a free end of said at least one tab being directed towards a second end of said lever arm and being engageable by the user.

8. A lever according to claim 7, wherein said at least one tab is flexible and has such dimensions as to interact with said base underlying said lever arm when said lever arm is closed, so as to flex during closure and push, once said closure has been completed, said second end of said lever arm so that said lever arm remains adjacent to said underlying base.

9. A lever according to claim 8, wherein, with respect to a cross-section taken longitudinally to said lever arm, the imaginary transverse axis of deformation of said tab is arranged at a distance, with respect to said second end of said lever arm, which is greater than the distance of the transverse axis of said first pivot, so as to generate a moment which forces said lever arm into contact with said base.

10. A lever according to claim 9, comprising, in a region which is intermediate between said first and second ends of said lever arm, a second pivot for said band at appropriate lugs, said band being associable at an adapted engagement element which is associable with said second flap, wherein said engagement element is internally hollow so as to allow insertion therein of the free end of said band, said band having, at the surface which faces said second flap, first teeth arranged transversely along part of the width of said band and interacting in a ratchet-like fashion with an adapted complementarily shaped first complementary set of teeth formed at said engagement element underlying said band.

11. A lever according to claim 10, wherein said first complementary set of teeth is constituted by a limited number of teeth.

12. A lever according to claim 10, wherein second teeth are provided on said band adjacent to said first teeth and are orientated in the opposite direction with respect to said first teeth, which interact with a complementarily shaped second complementary set of teeth formed on said engagement element laterally to said first complementary set of teeth.

13. A lever according to claim 12, wherein said first teeth and said first complementary set of teeth interact with each other so as to withstand traction when the lever arm is closed, whilst said second teeth and said second complementary set of teeth constitute a means for preventing reverse motion when the lever arm is open or closed.

* * * * *